US009385481B2

(12) United States Patent
Chung et al.

(10) Patent No.: US 9,385,481 B2
(45) Date of Patent: Jul. 5, 2016

(54) ELECTRONIC CONNECTOR

(71) Applicant: Kuang Ying Computer Equipment Co., Ltd., New Taipei (TW)

(72) Inventors: Hsuan-Ho Chung, New Taipei (TW); Yu-Hung Lin, New Taipei (TW)

(73) Assignee: KUANG YING COMPUTER EQUIPMENT CO., LTD., New Taipei (TW)

( * ) Notice: Subject to any disclaimer, the term of this patent is extended or adjusted under 35 U.S.C. 154(b) by 10 days.

(21) Appl. No.: 14/489,465

(22) Filed: Sep. 17, 2014

(65) Prior Publication Data

US 2016/0079712 A1 Mar. 17, 2016

(51) Int. Cl.
*H01R 24/60* (2011.01)
*H01R 13/6581* (2011.01)

(52) U.S. Cl.
CPC ..... *H01R 13/6581* (2013.01); *H01R 24/60* (2013.01)

(58) Field of Classification Search
CPC ..... H01R 24/60; H01R 35/025
See application file for complete search history.

(56) References Cited

U.S. PATENT DOCUMENTS 5,161,999 A * 11/1992 Broschard, III .... H01R 23/6873 439/567
5,236,375 A * 8/1993 Kachlic ..... H01R 13/6275 439/607.13
6,200,165 B1 * 3/2001 Simmel ..... H01R 13/65802 439/607.23

* cited by examiner

*Primary Examiner* — Truc Nguyen
(74) *Attorney, Agent, or Firm* — Leong C. Lei

(57) ABSTRACT

An electronic connector includes a transmission conductor group including two rows of plate-like contacts for insertion of a connector male portion in normal and reverse directions, a transmission conductor pin group, which is formed at a rear side of the transmission conductor group and arranged in a single row, a shielding housing, which receives therein the transmission conductor group, and an inclined cover section, which extends from the shielding housing to shield the transmission conductor pin group. As such, contacts of the transmission conductor group of the connector are provided in an arrangement of two rows so that mating between a male portion and a female portion can be made in a directionless manner, allowing for insertion in both normal and reverse directions. The transmission conductor pin group extending rearward from the transmission conductor group is set in an arrangement of a single row to maintain the convenience of manufacturing.

9 Claims, 14 Drawing Sheets

ELECTRONIC CONNECTOR

BACKGROUND OF THE INVENTION (a) Technical Field of the Invention

The present invention generally relates to an electronic connector for use with data processing facility, and more particularly to an electronic connector that provides convenience in both manufacturing and use thereof by allowing a connector male portion of the connector to insert therein, in a bidirectional manner, in both normal direction and reverse direction, while setting terminal pins on the same side of a circuit substrate and soldered in a single row.

(b) Description of the Prior Art

The prosperity of the electronic industry brings the demand of connectors for almost all the electronic products. Universal serial bus (USB) that is most commonly used in the market is an association defined standard interface specification for connectors. Such a specification is the most commonly used one and there are various improvements derived for the connectors, among which the most simple and easiest one is bidirectional insertability of connectors. Since mating between a male portion and a female portion of a connector is generally allowable in a fixed direction, due to various factors, such as inadvertency, during the operation by a user, it is often that insertion in an opposite direction occurs. Such an unexpected situation may cause a consequence of damaging the terminal pins of the connector, or even electrical shorting that destructs electronic facility. Thus, the bidirectionally pluggable connectors proposed by the manufacturers are indeed an improvement of convenience and usefulness.

However, such an improvement is limited to the specification of USB2.0. With the quick development of the modern technology, progress is made everyday. Connectors, such as USB2.0, USB3.0, Type-A, and Type-B, must advance with time in respect of for example increase of transmission speed and upgrading of hardware specification. However, such a bidirectional insertion connector is only applicable to USB2.0 and is not suitable for more advanced connectors.

Thus, it is a goal that the present inventor and those involved in the business are eager to achieve for overcoming the problems and drawbacks of the bidirectional insertion connector.

SUMMARY OF THE INVENTION

In view of the above-discussed drawbacks, the present invention aims to provide an electronic connector by expanding the technology of bidirectional insertion to cover various types of USB connector and integrating those connectors as a unitary device with the manufacturing process being achieved with the known techniques so as to enhance the convenience of the using side and the manufacturing side.

The primary object of the present invention is to achieve insertion of a connector male portion in both normal direction and reverse direction by means of two rows of plate-like contacts of a transmission conductor group and to maintain the easiness of soldering operations by means of an arrangement of a single row of a transmission conductor pin group, and to shield the transmission conductor group with an inclined cover section and two shielding enclosures so as to reduce the occurrence of electromagnetic interference and radio frequency interference.

To achieve the above object, the present invention provides a structure that comprises: a transmission conductor group that comprises two rows of plate-like contacts to allow for normal insertion and reverse insertion of a connector male portion, a transmission conductor pin group that is arranged at a rear side of the transmission conductor group in an arrangement of a single row, and a shielding housing for accommodating the transmission conductor group and an inclined cover section extending from the shielding housing to shield the transmission conductor pin group, whereby during the manufacture of the present invention in the manufacturing side, the two rows of the transmission conductor group are separated by a first shielding enclosure to be respectively located on upper and lower sides to allow for easy assembly and reduction of mutual interference and the transmission conductor pin group at the rear side of the two-rowed transmission conductor group is arranged, collectively, at one side of a circuit substrate to further ease the operations in the manufacturing side, and finally, the inclined cover section is used to shield the transmission conductor pin group to achieve further isolation of noise inside and outside the second shielding enclosure, so that the user may have the convenience of insertion in two directions with absolutely no concern about direction of insertion and the present invention provides a protection measure for noise isolation, allowing for use without unnecessary concern.

With the above-described technique, the problems of the conventional bidirectional insertion connectors that the range of application of the connector is not good and the manufacturing process is difficult can be overcome to achieve the above-discussed advantages.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
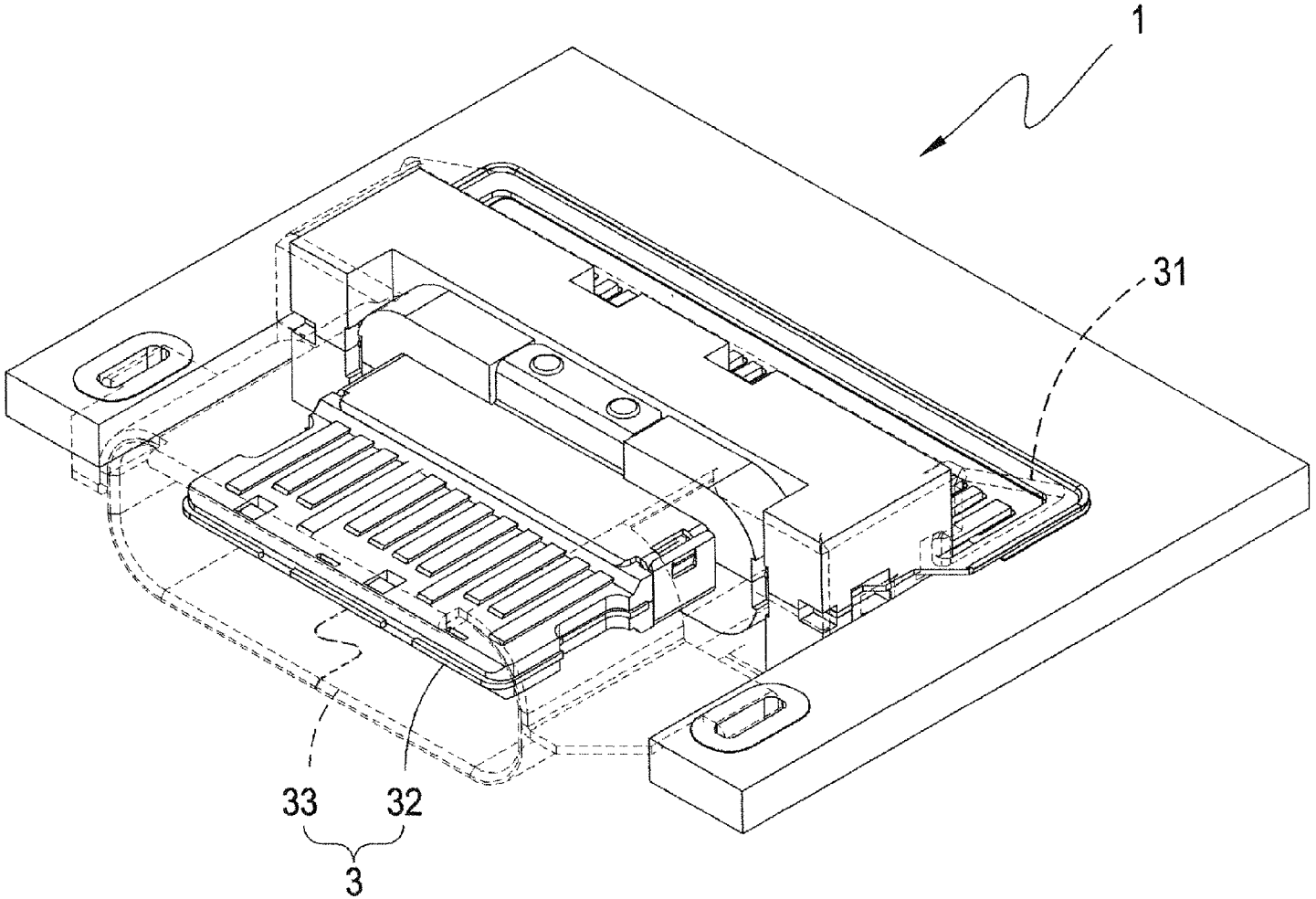
FIG. 1 is a perspective view of a preferred embodiment of the present invention.
Figure 2:
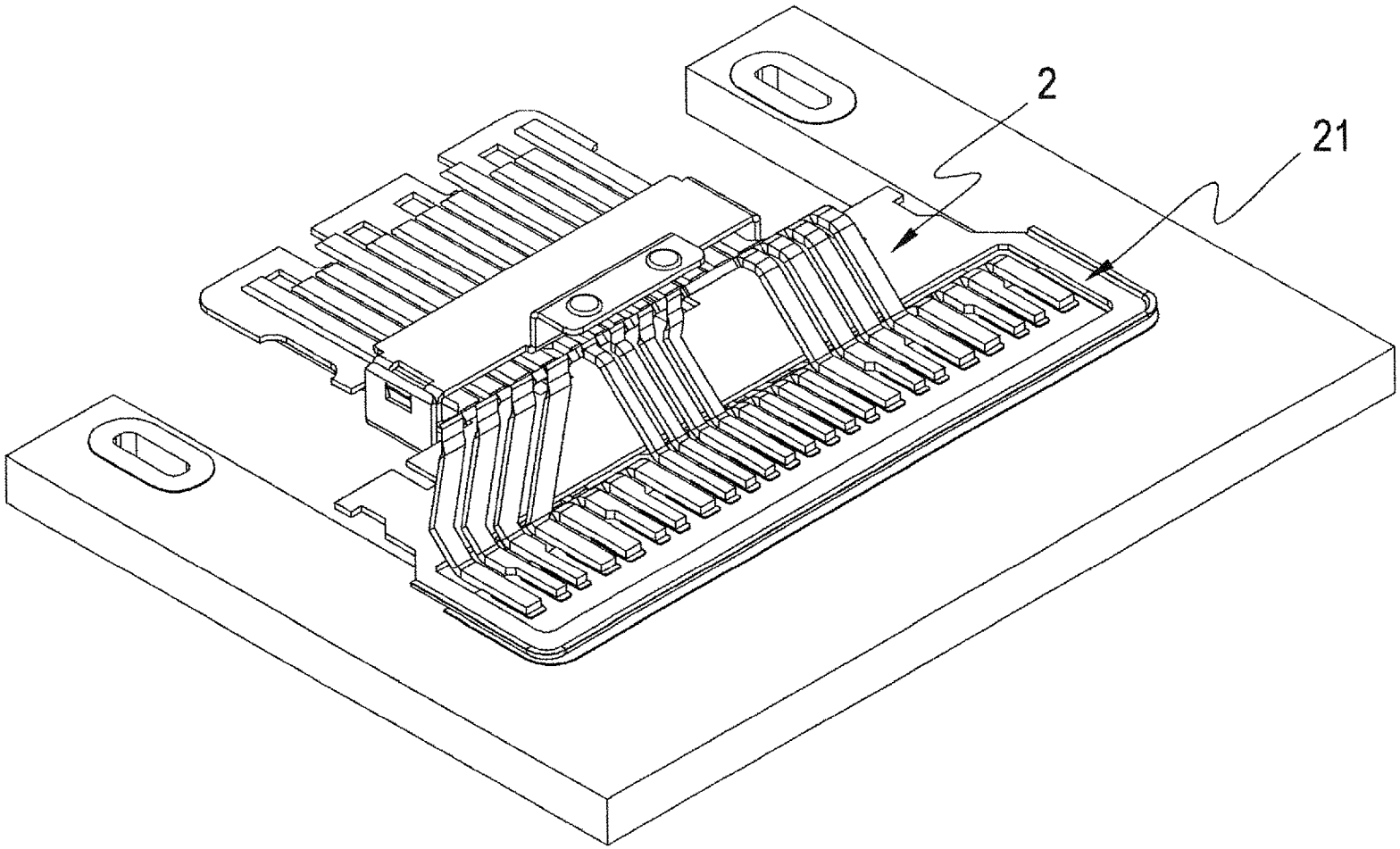
FIG. 2 is a perspective view showing two rows of pins of the preferred embodiment of the present invention.
Figure 3:
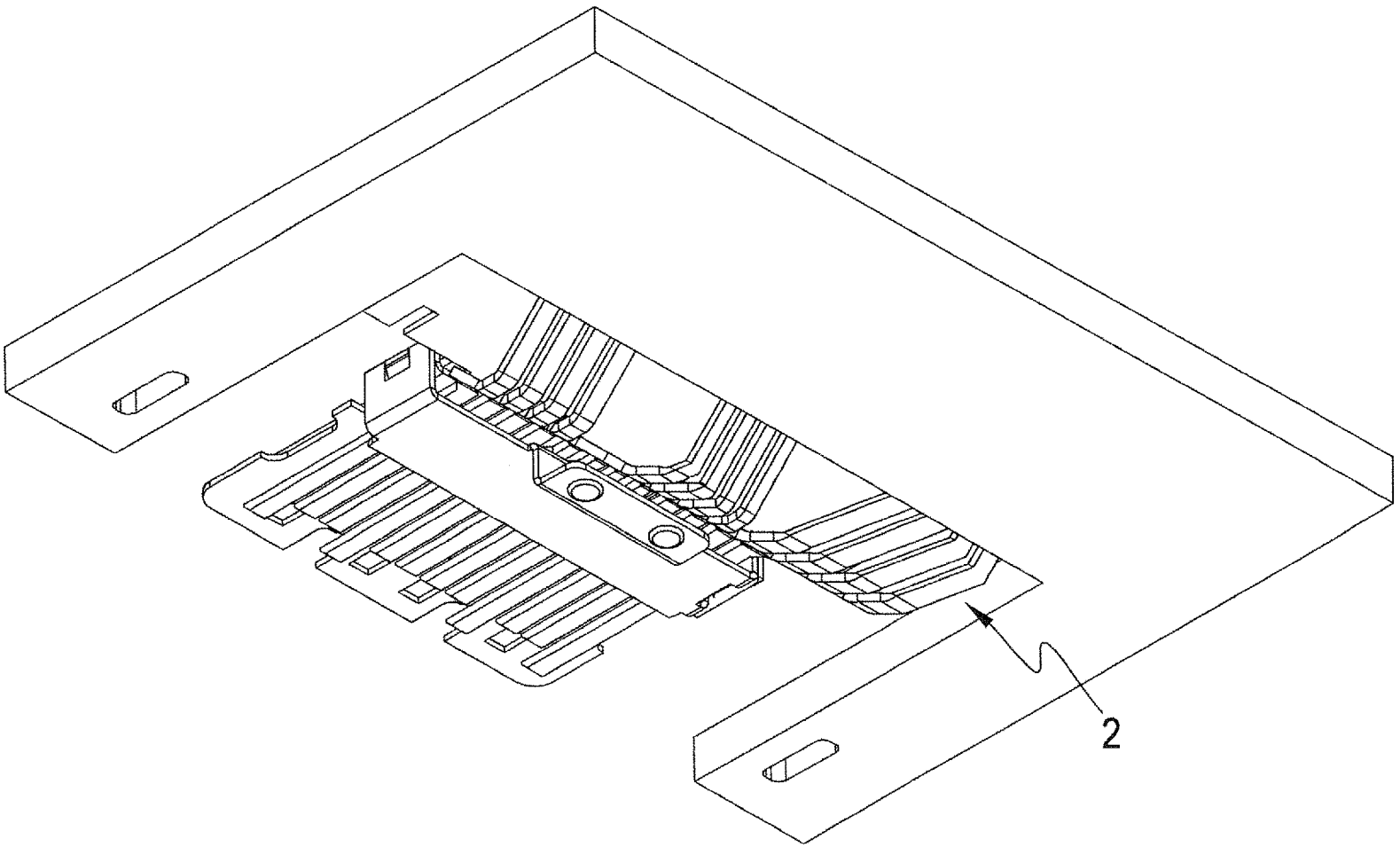
FIG. 3 is another perspective view showing two rows of pins of the preferred embodiment of the present invention.
Figure 4:
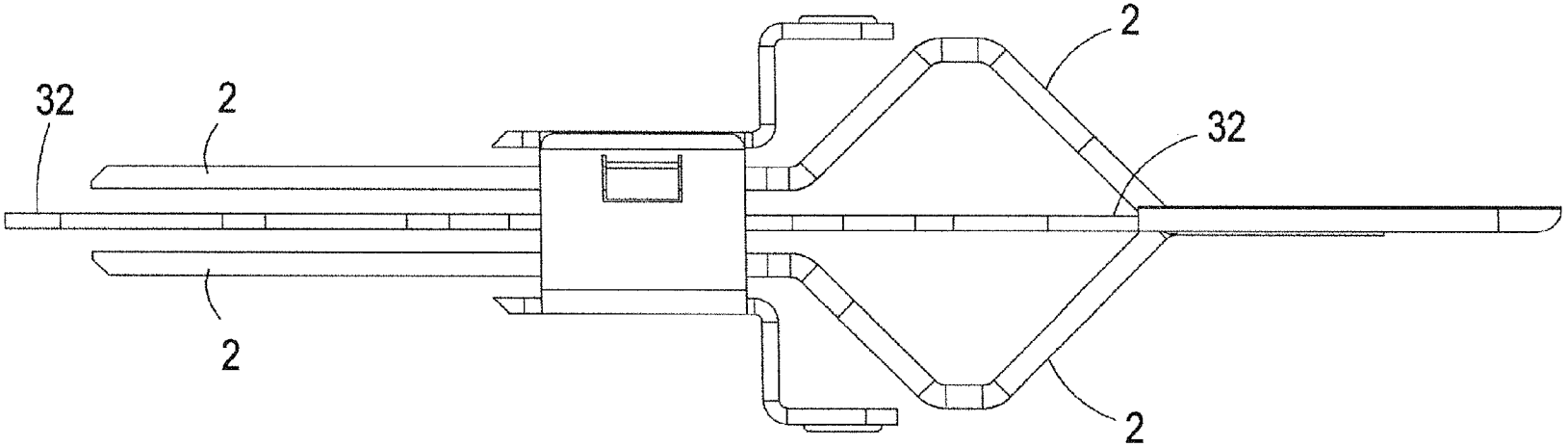
FIG. 4 is a side elevational view of the preferred embodiment of the present invention.
Figure 5:
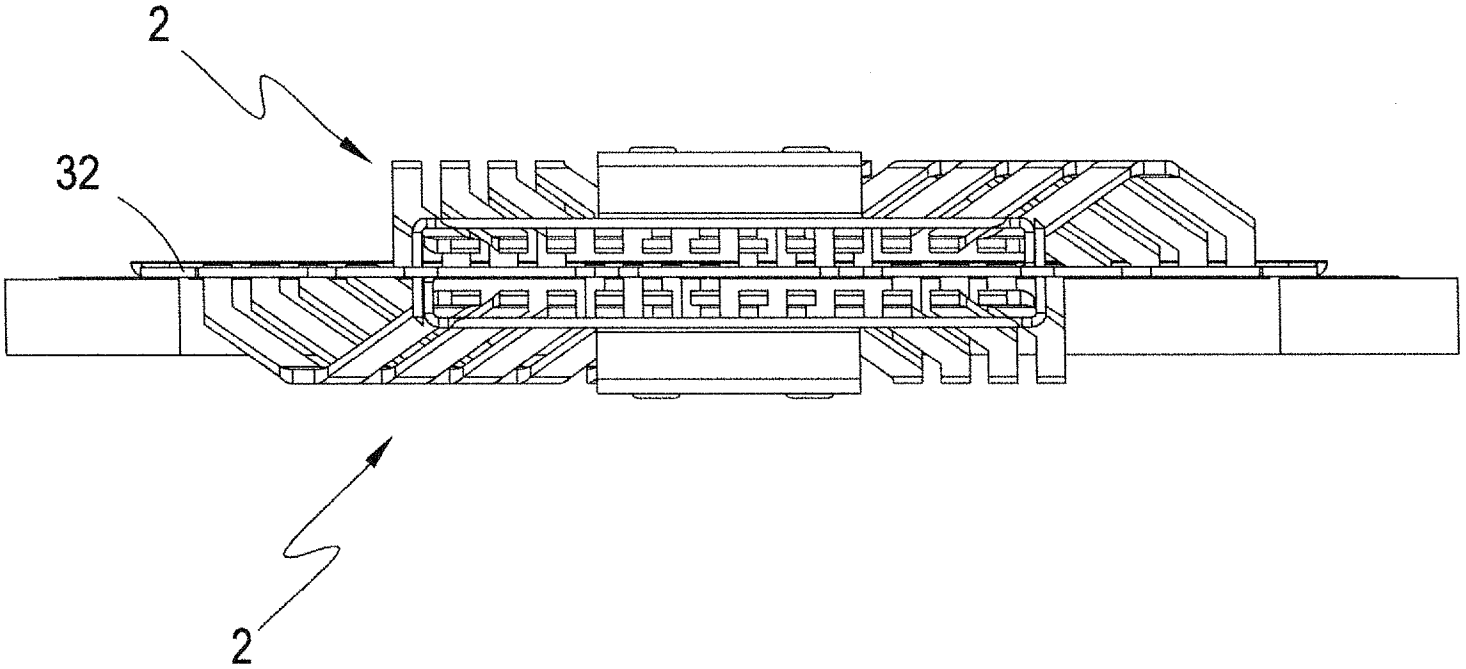
FIG. 5 is a front view of the preferred embodiment of the present invention.

Referring to FIGS. 1, 2, and 3, which are respectively a perspective view of a preferred embodiment of the present invention, a perspective view showing two rows of pins of the preferred embodiment of the present invention, and another perspective view showing two rows of pins of the preferred embodiment of the present invention, the drawings clearly show an electronic connector 1 in accordance with the present invention comprises:

a transmission conductor group 2, which comprises two rows of plate-like contacts and is provided for insertion of a connector male portion in both a normal direction and a reverse direction;

a transmission conductor pin group 21, which is formed rearward of the transmission conductor group 2 and is arranged in a single row;

a shielding housing 3, which receives the transmission conductor group 2 therein, the shielding housing 3 comprising an integrally-formed first shielding enclosure 32 that surrounds the transmission conductor group 2 and an integrally-formed second shielding enclosure 33 that houses the transmission conductor group 2; and an inclined cover section 31 that extends from the shielding housing 3 to shield the transmission conductor pin group 21.

Referring collectively to FIGS. 1-5, which are respectively a perspective view of a preferred embodiment of the present invention, a perspective view showing two rows of pins of the preferred embodiment of the present invention, another perspective view showing two rows of pins of the preferred embodiment of the present invention, a side elevational view of the preferred embodiment of the present invention, and a front view of the preferred embodiment of the present invention, the drawings clearly show that with the above-discussed components assembled, the transmission conductor group 2 that comprises two rows of plate-like contacts has an upper row and a lower row, which are separated from each other by the first shielding enclosure 32 to form the transmission conductor group 2 of which the upper and lower rows do not interfere with each other, so that when a user is operating the connector male portion, the convenience of achieving electrical connection through free insertion in both normal direction and reverse direction is provided. Further, the transmission conductor group 2 is received in the second shielding enclosure 33 and the inclined cover section 31 shields the transmission conductor pin group 21, an effect of isolating the inside and the outside of the electronic connector 1 with the two allows for effective suppression of electromagnetic interference (EMI) and radio frequency interference (RFI) according to the present invention. During the manufacture of the present invention, since the transmission conductor pin group 21 that is located at the rear side of the transmission conductor group 2 is arranged in a single row on a circuit substrate, the operation of the manufacturing side can be conducted in such a way that front-rear turning and errors of manual operation of incorrect connection can be eliminated. With the arrangement of the first shielding enclosure 32, it is possible to stabilize, in an indirect manner, the arrangement of the transmission conductor group 2 so that the present invention provides convenience for both the manufacturing side and the using side.

Figure 6:
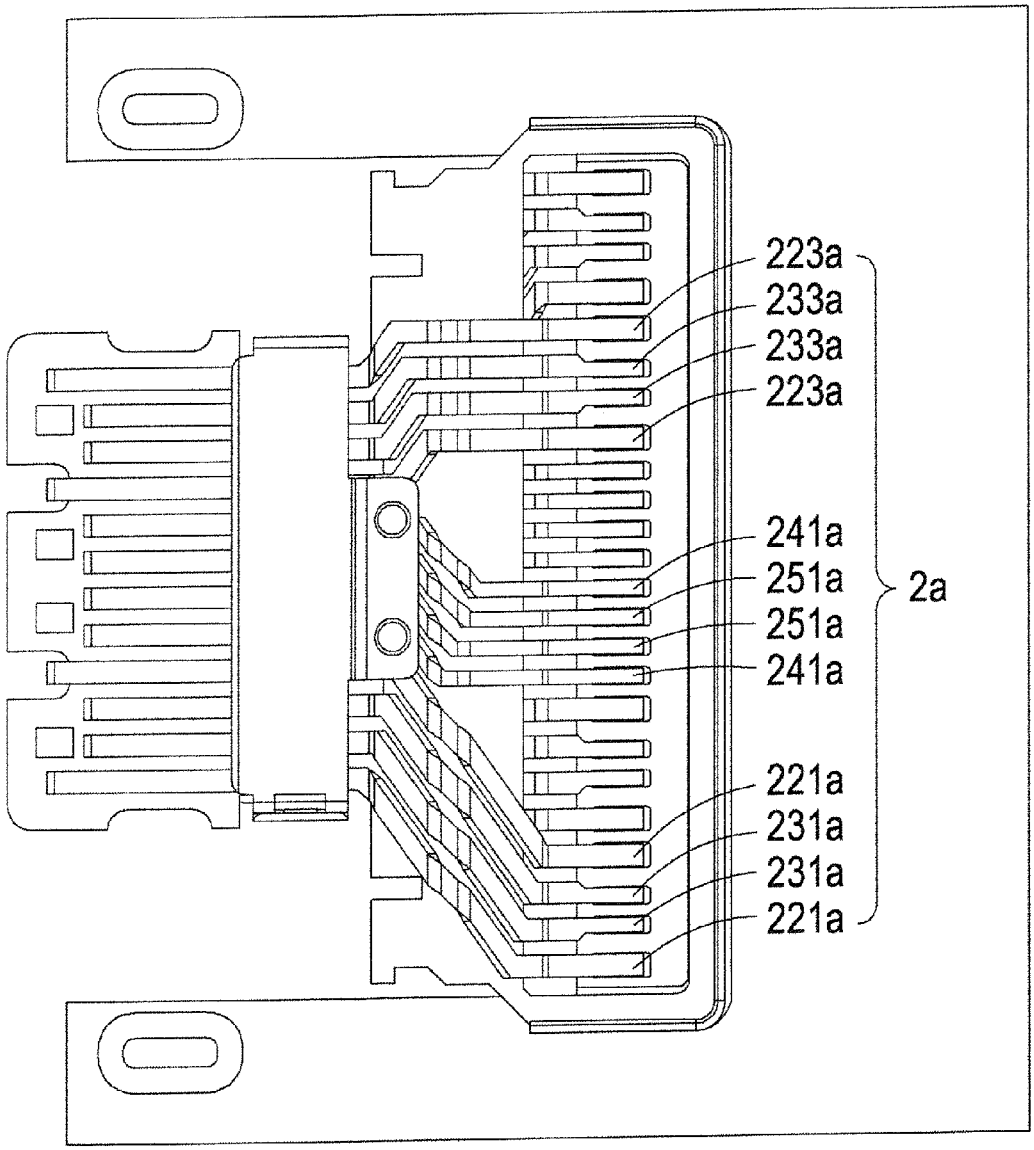
FIG. 6 is a first top plan view of transmission conductors of another embodiment of the present invention.
Figure 7:
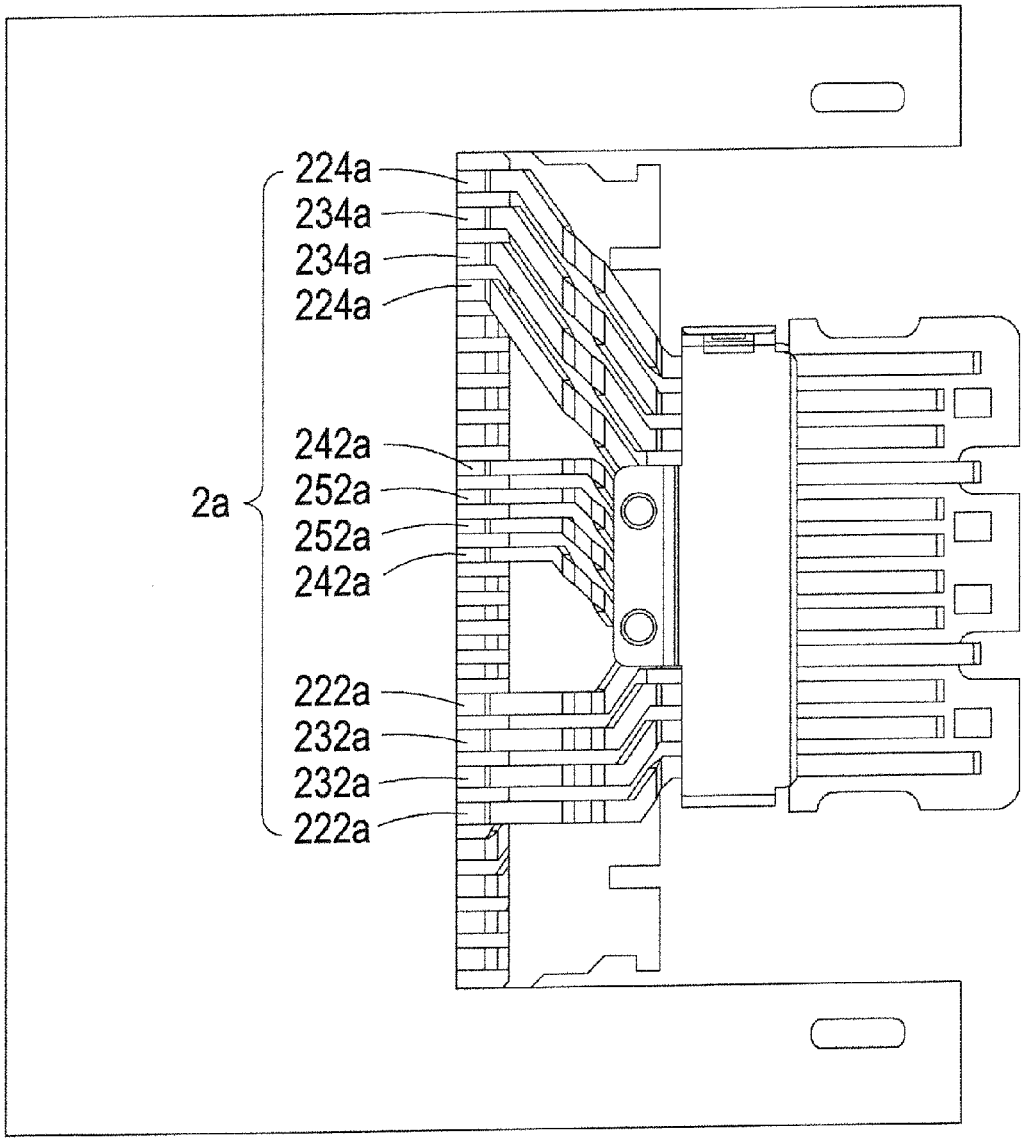
FIG. 7 is a first bottom view of transmission conductors of another embodiment of the present invention.

Further, collectively referring to FIGS. 6-11, which are respectively a first top plan view of transmission conductors of another embodiment of the present invention, a first bottom view of transmission conductors of another embodiment of the present invention, a second bottom view of transmission conductors of another embodiment of the present invention, a second top view of transmission conductors of another embodiment of the present invention, a third bottom view of the transmission conductors of another embodiment of the present invention, and a fourth bottom view of the transmission conductors of a further embodiment of the present invention, the drawings clearly show the function that is provided by the present invention to allow for insertion in normal direction and reverse direction of a connector male portion is applicable to USB connectors of various specifications, namely the technique provided by the present invention is applicable to various specifications including USB3.0 and USB2.0 and can be even modified to provide a USB interface specification that allows for different specifications for insertion in normal direction and reverse direction so that the present invention achieves a technical advance that possesses wide applications. FIGS. 6 and 7 represent one USB interface specification. In FIG. 6, an upper row of the transmission conductor group 2*a* comprises, in sequence, a first power transmission conductor pair 221*a*, a first signal control transmission conductor pair 241*a*, and a third power transmission conductor pair 223*a*, and a first differential signal transmission conductor pair 231*a* arranged between the first power transmission conductor pair 221*a*, a first data transmission conductor pair 251*a* arranged between the first signal control transmission conductor pair 241*a*, and a third differential signal transmission conductor pair 233*a* arranged between the third power transmission conductor pair 223*a*; in FIG. 7, a lower row of the transmission conductor group 2*a* comprises, in sequence, a second power transmission conductor pair 222*a*, a second signal control transmission conductor pair 242*a*, and a fourth power transmission conductor pair 224*a*, and a second differential signal transmission conductor pair 232*a* arranged between the second power transmission conductor pair 222*a*, a second data transmission conductor pair 252*a* arranged between the second signal control transmission conductor pair 242*a*, and a fourth differential signal transmission conductor pair 234*a* arranged between the fourth power transmission conductor pair 224*a*.

Figure 8:
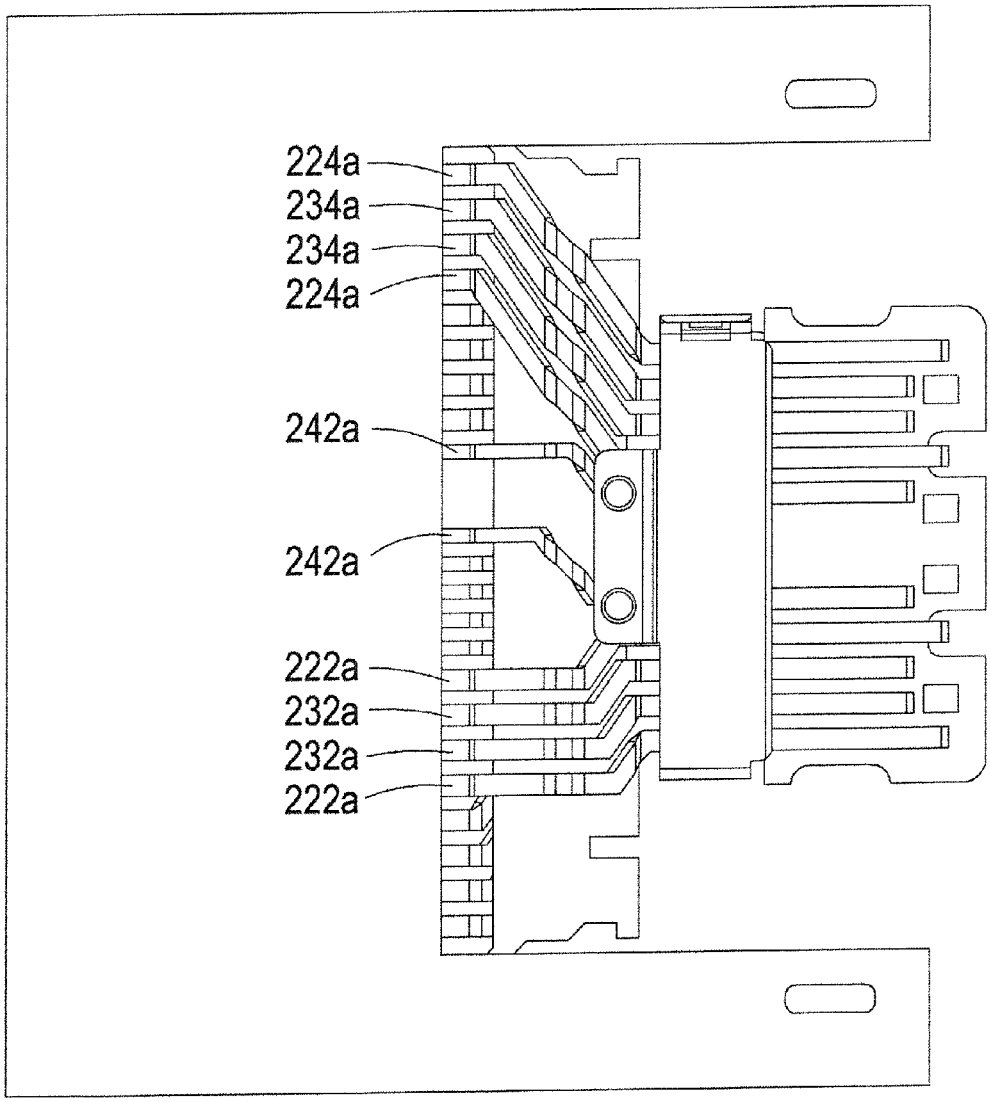
FIG. 8 is a second bottom view of transmission conductors of another embodiment of the present invention.
Figure 9:
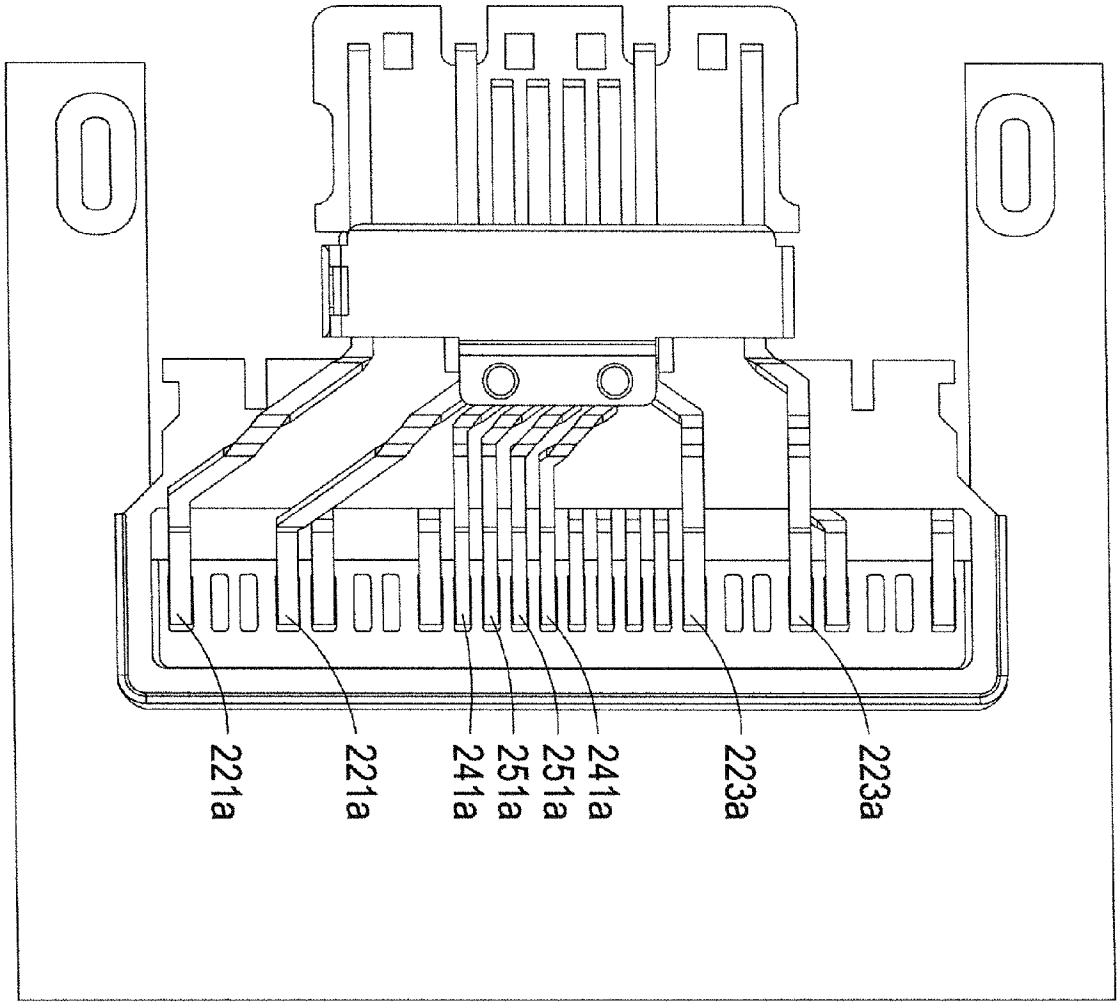
FIG. 9 is a second top view of transmission conductors of another embodiment of the present invention.
Figure 10:
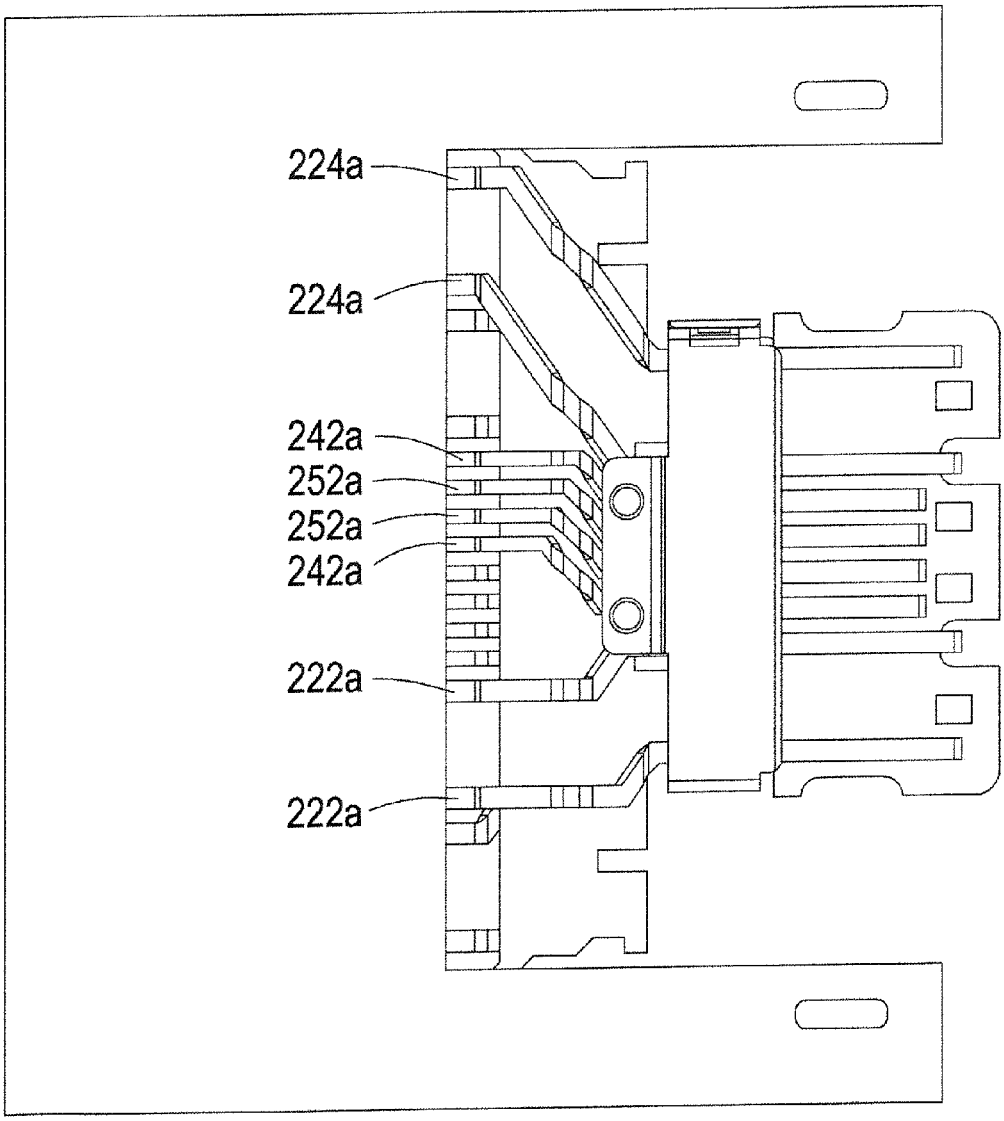
FIG. 10 is a third bottom view of the transmission conductors of another embodiment of the present invention.
Figure 11:
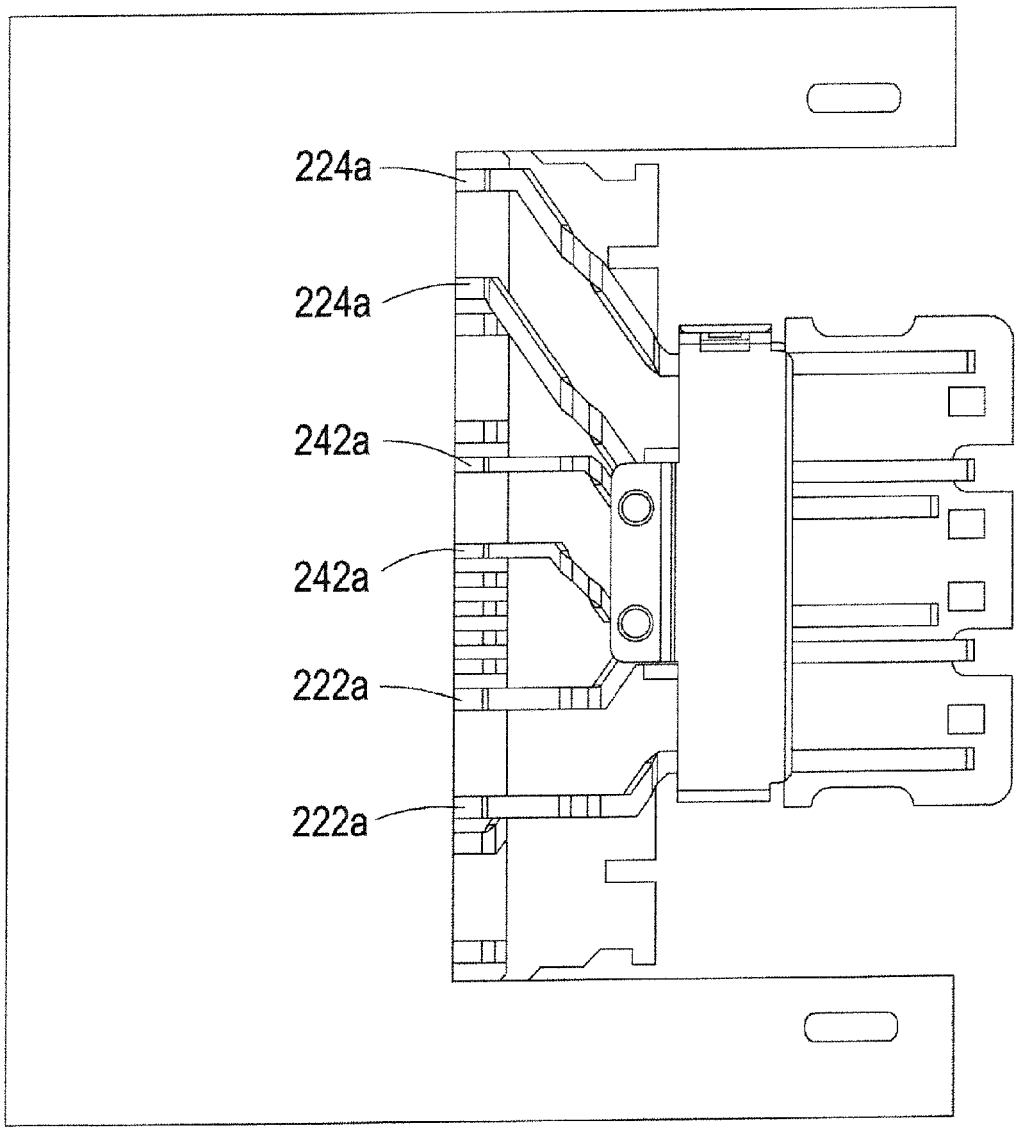
FIG. 11 is a fourth bottom view of the transmission conductors of a further embodiment of the present invention.

Further, in FIG. 8, for the USB pin arrangement described above, the second data transmission conductor pair 252*a* is removed to present two USB interfaces that have different specifications for the upper and lower sides. For a case that the first differential signal transmission conductor pair 231*a*, the second differential signal transmission conductor pair 232*a*, the third differential signal transmission conductor pair 233*a*, and the fourth differential signal transmission conductor pair 234*a* are removed, then as shown in FIGS. 9 and 10, a different USB interface specification is provided and allows for insertion in normal direction and reverse direction in a directionless manner. In a similar way, the second data transmission conductor pair 252*a* belonging to the lower row of the transmission conductor group 2*a* of FIG. 10 is removable to provide a further arrangement that two USB interfaces that are different from each other for normal direction insertion and reverse direction insertion, of which the configurations thereof are respectively shown in FIGS. 9 and 11.

Figure 12:
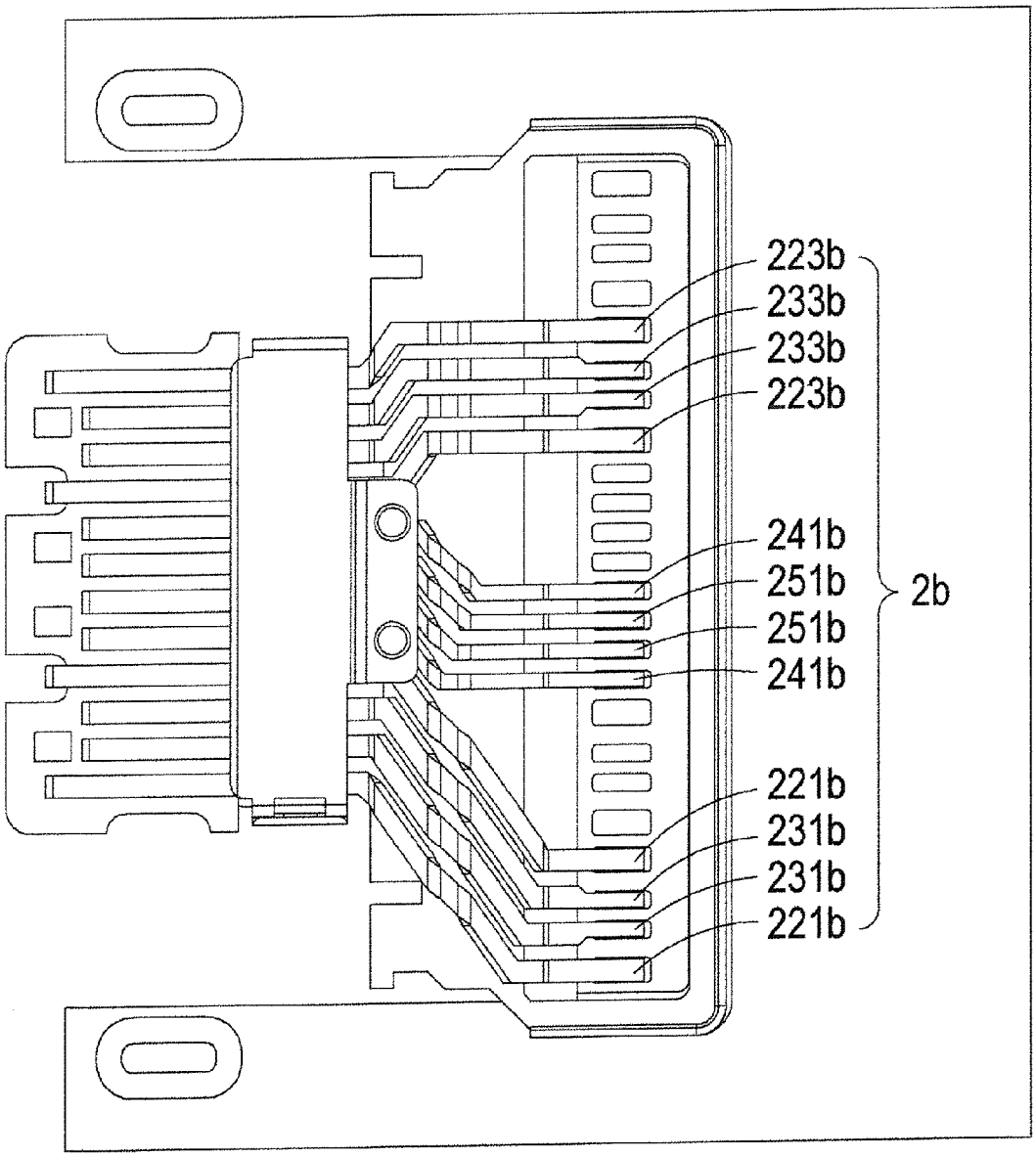
FIG. 12 is a first top view of transmission conductors of a further embodiment of the present invention.
Figure 13:
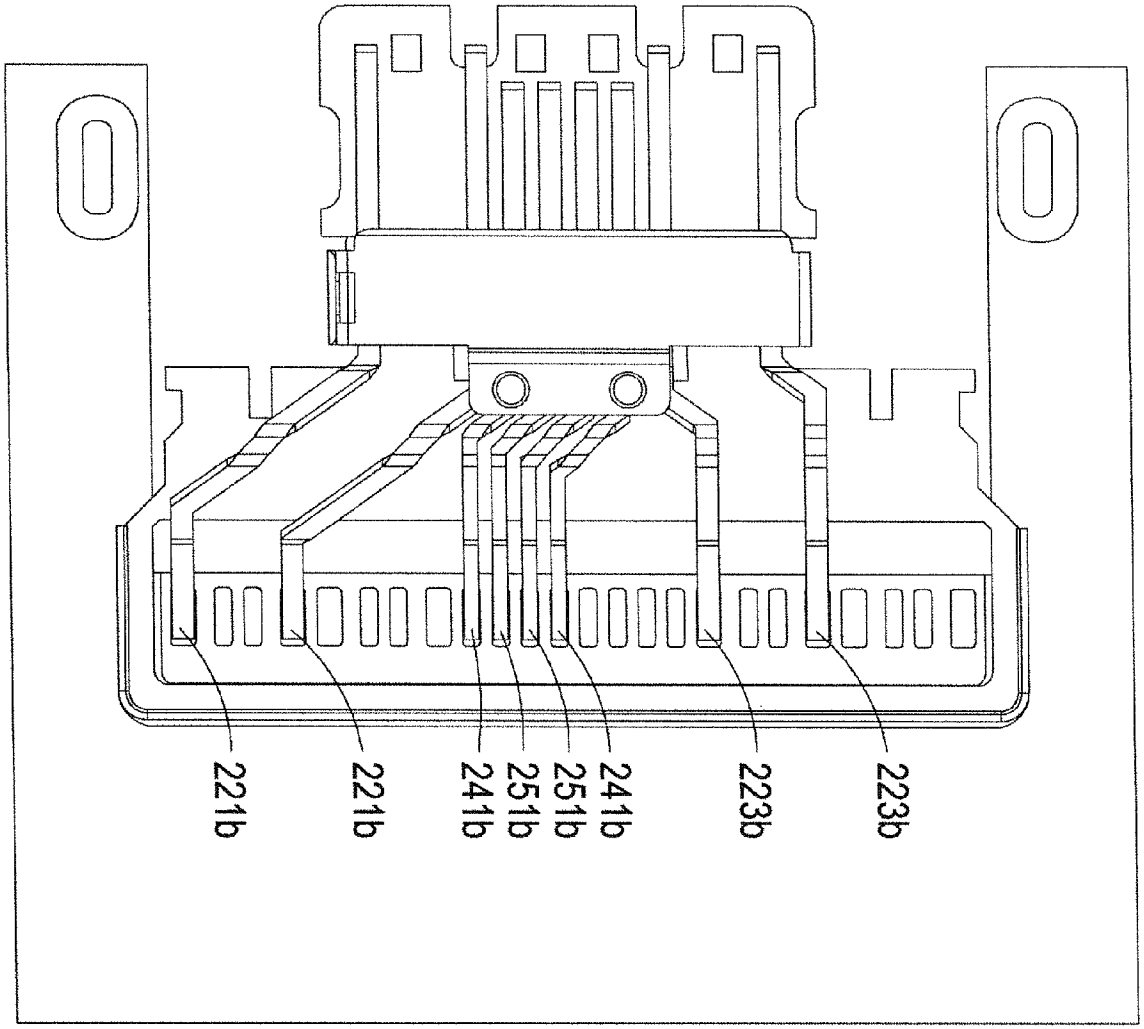
FIG. 13 is a second top view of the transmission conductors of a further embodiment of the present invention.
Figure 14:
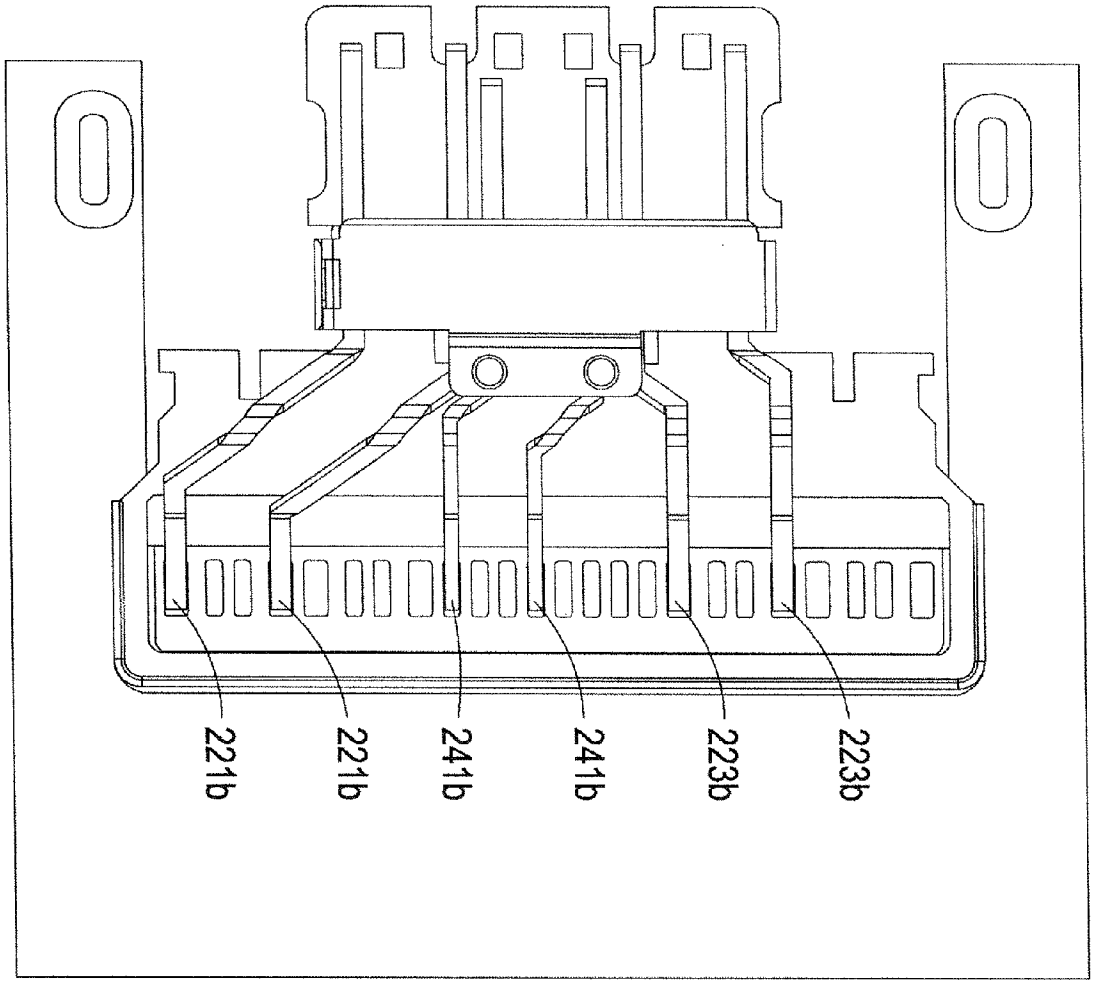
FIG. 14 is a third top view of the transmission conductors of a further embodiment of the present invention.

Referring to FIGS. 12-14, which are a first top view of transmission conductors of a further embodiment of the present invention, a second top view of the transmission conductors of a further embodiment of the present invention, and a third top view of the transmission conductors of a further embodiment of the present invention, the drawings clearly show that the use of the present invention is not limited to bidirectional insertion in normal and reverse directions. As shown in FIG. 12, the transmission conductor group 2*b* is arranged by completely eliminating a lower row and keeps only an upper row including a first power transmission conductor pair 221*b*, a first signal control transmission conductor pair 241*b*, and a third power transmission conductor pair 223*b*, and a first differential signal transmission conductor pair 231*b* arranged between the first power transmission conductor pair 221*b*, a first data transmission conductor pair 251*b* arranged between the first signal control transmission conductor pair 241*b*, and a third differential signal transmission conductor pair 233*b* arranged between the third power transmission conductor pair 223*b* so as to provide a USB interface specification of single-direction insertion, but still preserving the above described advantages of easy assembly, preventing undesired reverse direction insertion, and excellent isolation of noise. Further, FIG. 13 shows an example in which the first differential signal transmission conductor pair 231*b* and the third differential signal transmission conductor pair 233*b* are also removed and in FIG. 14, an example in provided, in which only the first power transmission conductor pair 221*b*, the third power transmission conductor pair 223*b*, and the first signal control transmission conductor pair 241*b* are preserved. FIGS. 13 and 14 each shows one USB interface specification of single-direction insertion.

Thus, the present invention provides an electronic connector that provides the following key features to overcome the prior art techniques:

(1) Insertion of a connector male portion into a connector female portion that comprises two rows of contacts is allowed for both normal direction and reverse direction.

(2) An arrangement of a single row of transmission conductor pin group 21 is used to enhance the operations in the manufacturing side.

(3) The feature of insertion in both normal and reverse directions is applicable to connectors of various specifications.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An electronic connector, comprising:

a transmission conductor group, which comprises upper and lower rows of plate-like contacts for insertion of a connector male portion in normal and reverse directions;

a transmission conductor pin group, which is formed at a rear side of the transmission conductor group and arranged in a single row;

a shielding housing, which receives therein the transmission conductor group; and an inclined cover section, which extends from the shielding housing to shield the transmission conductor pin group;

wherein the plate-like contacts of the upper row of the transmission conductor group are arranged on a first horizontal plane, where a major surface of each of the plate-like contacts of the upper row is substantially parallel to the first horizontal plane and coplanar with each other, and the plate-like contacts of the lower row are arranged on a second horizontal plane that is substantially parallel to and spaced, in a vertical direction, from the first plane, where a major surface of each of the plate-like contacts of the lower row is substantially parallel to the second horizontal plane and coplanar with each other; and wherein the shielding housing comprises a first shielding enclosure that extends on a horizontal plane to circumferentially surround the transmission conductor group and is located between the first and second planes of the upper and lower rows of the plate-like contacts and a second shielding enclosure that extends on a vertical plane to circumferentially surround and thus house the plate-like contacts of both the upper and lower rows of the transmission conductor group therein.

2. The electronic connector according to claim 1, wherein the transmission conductor group comprises an upper row that comprises a first power transmission conductor pair, a first differential signal transmission conductor pair arranged between the first power transmission conductor pair, a first signal control transmission conductor pair arranged at one side of the first power transmission conductor pair, a first data transmission conductor pair arranged between the first signal control transmission conductor pair, a third power transmission conductor pair arranged at one side of the first signal control transmission conductor pair that is distant from the first power transmission conductor pair, and a third differential signal transmission conductor pair arranged between the third power transmission conductor pair, and the transmission conductor group comprises a lower row that comprises a second power transmission conductor pair, a second differential signal transmission conductor pair arranged between the second power transmission conductor pair, a second signal control transmission conductor pair arranged at one side of the second power transmission conductor pair, a second data transmission conductor pair arranged between the second signal control transmission conductor pair, a fourth power transmission conductor pair arranged at one side of the second signal control transmission conductor pair that is distant from the second power transmission conductor pair, and a fourth differential signal transmission conductor pair arranged between the fourth power transmission conductor pair.

3. The electronic connector according to claim 1, wherein the transmission conductor group comprises an upper row that comprises a first power transmission conductor pair, a first differential signal transmission conductor pair arranged between the first power transmission conductor pair, a first signal control transmission conductor pair arranged at one side of the first power transmission conductor pair, a first data transmission conductor pair arranged between the first signal control transmission conductor pair, a third power transmission conductor pair arranged at one side of the first signal control transmission conductor pair that is distant from the first power transmission conductor pair, and a third differential signal transmission conductor pair arranged between the third power transmission conductor pair, and the transmission conductor group comprises a lower row that comprises a second power transmission conductor pair, a second differential signal transmission conductor pair arranged between the second power transmission conductor pair, a second signal control transmission conductor pair arranged at one side of the second power transmission conductor pair, a fourth power transmission conductor pair arranged at one side of the second signal control transmission conductor pair that is distant from the second power transmission conductor pair, and a fourth differential signal transmission conductor pair arranged between the fourth power transmission conductor pair.

4. The electronic connector according to claim 1, wherein the transmission conductor group comprises an upper row comprising a first power transmission conductor pair, a first signal control transmission conductor pair arranged at one side of the first power transmission conductor pair, a first data transmission conductor pair arranged between the first signal control transmission conductor pair, and a third power transmission conductor pair arranged at one side of the first signal control transmission conductor pair that is distant from the first power transmission conductor pair, and the transmission conductor group comprises a lower row comprising a second power transmission conductor pair, a second signal control transmission conductor pair arranged at one side of the second power transmission conductor pair, a second data transmission conductor pair arranged between the second signal control transmission conductor pair and a fourth power transmission conductor pair arranged at one side of the second signal control transmission conductor pair that is distant from the second power transmission conductor pair.

5. The electronic connector according to claim 1, wherein the transmission conductor group comprises an upper row comprising a first power transmission conductor pair, a first signal control transmission conductor pair arranged at one side of the first power transmission conductor pair, a first data transmission conductor pair arranged between the first signal control transmission conductor pair, and a third power transmission conductor pair arranged at one side of the first signal control transmission conductor pair that is distant from the first power transmission conductor, and the transmission conductor group comprises a lower row comprising a second power transmission conductor pair, a second signal control transmission conductor pair arranged at one side of the second power transmission conductor pair, and a fourth power transmission conductor pair arranged at one side the second signal control transmission conductor pair that is distant from the second power transmission conductor pair.

6. An electronic connector, comprising:

a transmission conductor group, which comprises one row of plate-like contacts for insertion of a connector male portion in normal and reverse directions;

a transmission conductor pin group, which is formed at a rear side of the transmission conductor group and arranged in a single row;

a shielding housing, which receives therein the transmission conductor group; and an inclined cover section, which extends from the shielding housing to shield the transmission conductor pin group;

wherein the row of the plate-like contacts the transmission conductor group is arranged on a horizontal plane, where a major surface of each of the plate-like contacts of the upper row is substantially parallel to the horizontal plane and coplanar with each other; and wherein the shielding housing comprises a first shielding enclosure that extends on a horizontal plane to circumferentially surround the transmission conductor group and a second shielding enclosure that extends on a vertical plane to circumferentially surround and thus house the plate-like contacts of the transmission conductor group therein.

7. The electronic connector according to claim 6, wherein the transmission conductor group comprises a first power transmission conductor pair, a first differential signal transmission conductor pair arranged between the first power transmission conductor pair, a first signal control transmission conductor pair arranged at one side of the first power transmission conductor pair, a first data transmission conductor pair arranged between the first signal control transmission conductor pair, a third power transmission conductor pair arranged at one side of the first signal control transmission conductor pair that is distant from the first power transmission conductor pair, and a third differential signal transmission conductor pair arranged between the third power transmission conductor pair.

8. The electronic connector according to claim 6, wherein the transmission conductor group comprises a first power transmission conductor pair, a first signal control transmission conductor pair arranged at one side of the first power transmission conductor pair, a first data transmission conductor pair arranged between the first signal control transmission conductor pair, and a third power transmission conductor pair arranged at one side of the first signal control transmission conductor pair that is distant from the first power transmission conductor pair.

9. The electronic connector according to claim 6, wherein the transmission conductor group comprises a first power transmission conductor pair, a first signal control transmission conductor pair arranged at one side of the first power transmission conductor pair, and a third power transmission conductor pair arranged at one side of the first signal control transmission conductor pair that is distant from the first power transmission conductor pair.

* * * * *